United States Patent [19]

McKenna et al.

[11] Patent Number: 4,674,802

[45] Date of Patent: Jun. 23, 1987

[54] MULTI-INSERT CUTTER BIT

[75] Inventors: Alex G. McKenna, Ligonier; Clyde G. Hutzell, Schellsburg, both of Pa.

[73] Assignee: Kennametal, Inc, Latrobe, Pa.

[21] Appl. No.: 524,350

[22] Filed: Aug. 18, 1983

Related U.S. Application Data

[63] Continuation-in-part of Ser. No. 424,311, Sep. 17, 1982, abandoned.

[51] Int. Cl.[4] ..... E21C 35/18

[52] U.S. Cl. ..... 299/79; 175/410

[58] Field of Search ..... 299/91-93, 299/79; 175/410, 374, 375, 329, 379; 37/142 R, 142 A

[56] References Cited

U.S. PATENT DOCUMENTS

| | | | |
|---|---|---|---|
| 2,521,089 | 9/1950 | Phipps | 175/410 X |
| 2,549,088 | 4/1951 | Hettelsater et al. | 299/91 X |
| 3,246,930 | 4/1966 | Kiekeler | 299/92 |
| 3,280,927 | 10/1966 | Petersen | 299/92 X |
| 3,294,186 | 12/1966 | Buell | 175/410 |
| 3,311,181 | 3/1967 | Fowler | 175/410 |
| 3,618,683 | 11/1971 | Hughes | 299/92 X |
| 3,805,423 | 4/1974 | Engel et al. | 37/142 R |
| 4,005,906 | 2/1977 | McKenry et al. | 299/91 |
| 4,083,605 | 4/1978 | College et al. | 299/91 |
| 4,181,187 | 1/1980 | Lumen | 299/91 X |
| 4,187,626 | 2/1980 | Greer et al. | 37/142 R X |
| 4,194,790 | 3/1980 | Kenny et al. | 175/410 X |
| 4,221,270 | 9/1980 | Vezirian | 175/410 |
| 4,274,677 | 6/1981 | Proctor | 299/92 |
| 4,277,106 | 7/1981 | Sahley | 299/79 |
| 4,498,549 | 2/1985 | Jurgens | 175/329 |

FOREIGN PATENT DOCUMENTS

| | | | |
|---|---|---|---|
| 1203714 | 10/1965 | Fed. Rep. of Germany | 299/79 |
| 1498996 | 10/1967 | France | 299/91 |
| 0859628 | 8/1981 | U.S.S.R. | 299/79 |

*Primary Examiner*—Stephen J. Novosad
*Assistant Examiner*—Michael A. Goodman
*Attorney, Agent, or Firm*—John J. Prizzi

[57] ABSTRACT

A cutter bit is disclosed having a shank with a forward working portion and multiple inserts mounted on the forward working portion. One of the inserts is a lead insert facing and projecting foremost in the direction of rotation or travel of the bit. A clearance face is provided rearwardly of the lead insert so as to reduce the rubbing action that occurs between the cutter bit and the material formation to be removed. The lead insert can be a laminated insert with a metal shim between individual inserts. Another insert is located rearwardly of the lead insert in the clearance face of the bit and projects out of said clearance face to control the wear of the clearance face during the life of the cutter bit. A cutting edge may be formed on the wear controlling insert projecting from the clearance face.

14 Claims, 18 Drawing Figures

Fig. 4A
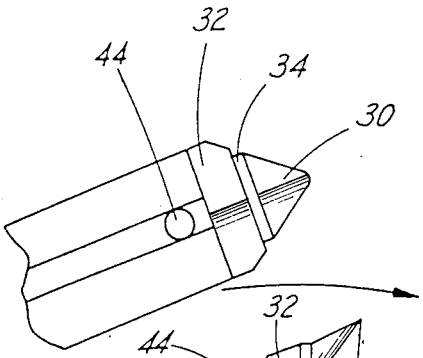
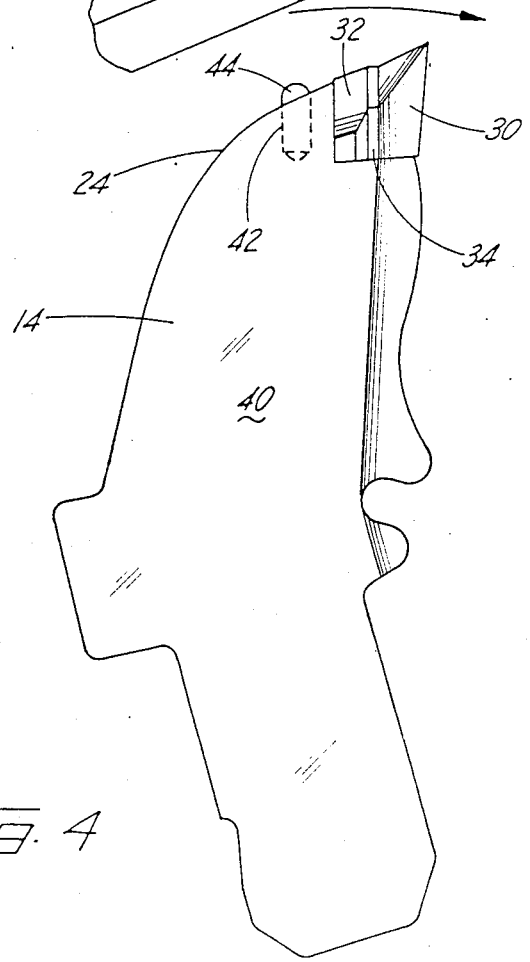
Fig. 4

Fig. 9
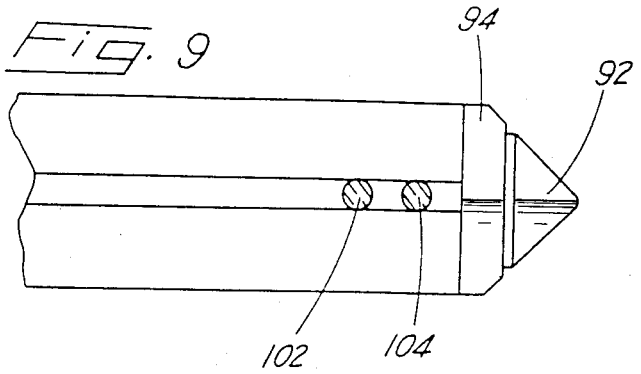
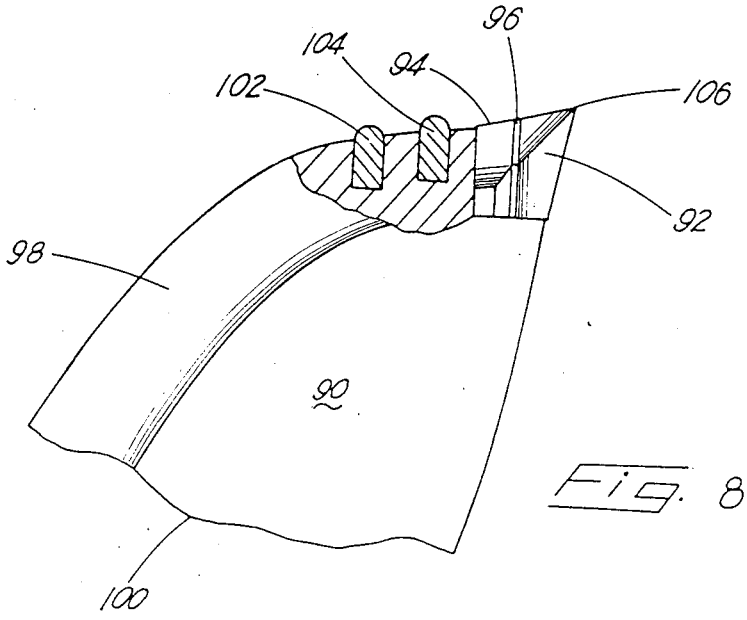
Fig. 8

112
108
110
112
111
110
108
4°

105
106

Fig. 13A
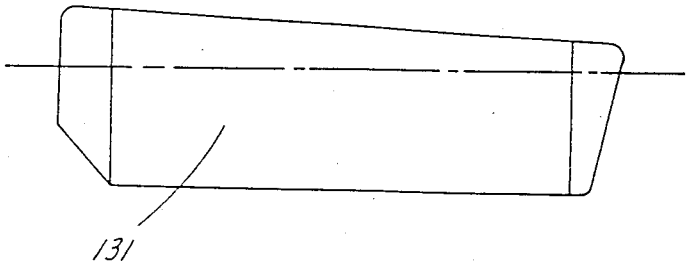
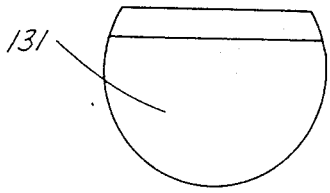
Fig. 13

MULTI-INSERT CUTTER BIT

BACKGROUND OF THE INVENTION

This invention concerns cutter bits for the mining industry and is especially concerned with long wall mining bits used in removing coal, potash or trona formations.

Cutter bits used in mining operations are comprised of a shank for insertion into a toolholder with a forward working portion on the shank for engagement with the material formation. An individual insert of hard wear resistant material has been provided on the forward working portion to cut into the coal or mineral formation and to enhance the life of the bit as it removes the mineral formation.

With long wall mining bits, the insert is positioned to face the direction of rotation of the bit and has a cutting edge on the insert impacting the mineral formation. A clearance face is provided behind the insert to reduce the rubbing of the forward working portion against the mineral formation as the bit passes through the formation.

A plurality of the cutters are usually mounted on a drum that typically might be rotated at 60 revolutions/-minute while the drum is driven into and along a face of a coal formation at about 20 to 40 feet/minute. The forward working portion of the cutter bits usually penetrate the coal formation by up to two to four inches. The coal formation is removed by the cutting, picking, and hammering of the cutter bits as the drum rotates and is moved along the face.

Typically, in long wall mining of coal formations, the drum may pass along a face of a coal seam with operator access to the drum occurring only at the end of each pass.

As the cutter bit becomes used, wear develops across the forward working portion of the bit extending from the leading cutting edge of the insert rearwardly across the clearance face. The reduced clearance increases the rubbing and abrasion of the forward working portion against the coal formation, generating excessive heat frequently causing the insert to fail due to heat checking. As the wear scar develops across the clearance face of the bits, machine power consumption rises, sometimes stalling the machine.

The cutting edge of the insert on the cutter bits faces in the direction of rotation of the bit and, when viewed from a front view, the cutting edge tapers outwardly toward the shank and is preferably V-shaped or U-shaped with the V or the U opening toward the shank of the bit. It is desirable to keep this configuration for the life of the bit rather than to let the cutting edge wear to a flat. When the cutting edge does wear to a flat, not only is more power required, but more dust is also created in the mine.

It is an object of the present invention to provide a cutter bit that is more durable than previous mining bits.

It is a further object of the present invention to enhance the life of the cutter bits by reducing the heat generated by the rubbing of the clearance face against the coal formation.

It is still a further object of the present invention to enhance the life of the cutter bits by minimizing the propagation of cracks due to heat checking of the carbide.

It is still a further object of the present invention to enhance the life of the cutter bit by controlling the wear of the clearance face so as to provide a self-sharpening cutter bit.

It is a further object of the present invention to make the life of the cutter bit more predictable, enabling bit changes to be made at the end of a pass, when the cutter drum is more accessible.

BRIEF SUMMARY OF THE INVENTION

The present invention involves a cutter bit having a shank for insertion into a toolholder and a forward working portion having multiple inserts with at least a lead cutting insert having a cutting edge for removing hard and abrasive mineral formations.

The inserts are composed of a hard wear resistant material, such as a cemented carbide, and a lead insert is mounted on the forward working portion of the bit and faces and projects foremost in the direction of intended travel of the bit. A clearance face is located rearwardly of the hard wear resistant lead insert to reduce rubbing against the mineral formation as it is being removed.

According to the present invention, the lead insert may be a single piece of carbide or a laminated insert having at least two or more individual inserts bonded to the cutter body.

Further according to the present invention, an additional insert may be mounted in the clearance face behind the insert and have a cutting edge thereon. The multiple inserts enhance the life of the bit by reducing wear of the forward working portion behind the lead insert and preserving the taper on the forward working portion of the bit.

The benefit of maintaining the taper on the forward working portion is to create a self-sharpening effect and reduce the heat generated by the friction of the bit passing through the coal or mineral formation. This reduces failure of the inserts due to heat checking and the wear resistant properties of the inserts will be more fully utilized. The additional insert mounted on the clearance face protrudes beyond the clearance face and may have a cutting edge of its own at the beginning of the life of the bit. The additional insert controlling the wear pattern of the clearance face helps reduce the wear on the lead insert and create the self sharpening effect which reduces the power required per unit volume of mineral or coal produced.

The additional insert placed in the clearance face comprises forming a recess in the clearance face behind the lead insert and fastening in the recess an insert of hard wear resistant material that projects above the clearance face, preferably a wear resistant cemented hard metal carbide although other materials, such as ceramics, diamonds, hardfacing materials, etc., are contemplated.

The recess formed in the clearance face may take the form of a cylindrical hole, a series of cylindrical holes, an elongated slot, or slots, or an additional insert attached to a surface behind the direction of travel of the lead insert.

Along with the possible cutting edge on the additional insert in the clearance face, the present invention further contemplates the lead insert comprising at least two inserts with cutting edges placed in an adjacent relation to one another so that if one insert fails the second insert presents its cutting edge to the material to be removed. The preferable mode is arranging at least two inserts with cutting edges as described together to form a laminated insert on the forward working portion of the bit with at least two individual inserts brazed to a metal shim. The cutting edges of the individual inserts are arranged facing the direction of rotation of the bit and so positioned one behind the other that if the leading cutting edge either wears away or fractures the following cutting edge comes into operation against the mineral formation. The leading cutting edge is preferably thicker and narrower than the following cutting edge so as to provide greater wear resistance at the center of the cutting edge.

The preferred mode according to the present invention is to mount at least one or more cylindrical inserts in the clearance face and have their uppermost tips project above the lead cutting tip and intersect a line that forms an included angle of six degrees with a plane perpendicular to the longitudinal area of the bit and passing through the apex of the cutting edge of the lead insert.

Preferably, the individual cutting inserts are comprised of a cemented metal carbide material and have a metal shim member dividing the two inserts. The carbide inserts are brazed to the metal shim member and the entire assembly is brazed in a pocket formed on the forward working portion of the cutter bit.

In a preferred mode, it is believed that the lead insert is comprised of a tough impact resistant carbide material and the others are comprised of a wear resistant carbide material.

BRIEF DESCRIPTION OF THE DRAWINGS

The exact nature of the present invention will become more clearly apparent upon reference to the following detailed specification taken in connection with the accompanying drawings in which:

FIG. 4 is a side view of one embodiment of a multi-insert cutter bit according to the present invention.

FIG. 4A is a partial top view of the cutter bit of FIG. 4.

FIG. 8 is a side view of a cutter bit according to the present invention.

FIG. 9 is a top view of a cutter bit of FIG. 8.

FIG. 11A is a top view of FIG. 11.

FIG. 13 is an end view of a cutting insert according to the present invention.

FIG. 13A is a side view of a cutting insert according to the present invention.

DETAILED DESCRIPTION OF THE INVENTION

Figure 1:
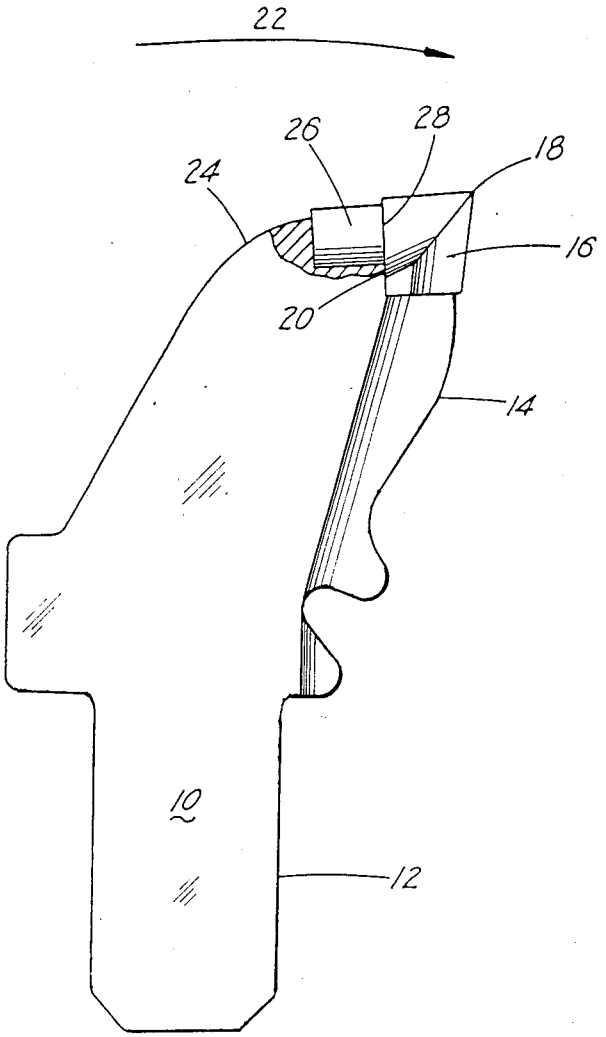
FIG. 1 is a partially cut away side view of a cutter bit according to the present invention.

Referring to the drawings somewhat more in detail, shown in FIG. 1 is a partially cut away view of a cutter bit 10 having a flat rectangular shank portion 12 and a forward working portion 14 with a sloped or curved clearance face 24. Mounted on the forward working portion 14 is a cutting insert 16 having a cutting edge 18 formed on the insert 16. The insert 16 is usually comprised of a hard wear resistant material, such as a cemented hard metal carbide material, and is brazed in a pocket 20 formed on the forward working portion 14.

The direction of travel of the bit 10 is indicated as at arrow 22 with the bit 10 being driven against a formation to be reduced. Located rearwardly of the direction of travel of the cutting edge 18 is the clearance face 24 on forward working portion 14. Clearance face 24 is configured so as to reduce the rubbing of the rearmost part of the forward working portion 14 of cutter bit 10 as it is driven through the mineral formation.

According to the present invention, a hard wear resistant means 26 is mounted in and protrudes from the clearance face 24 and is located behind the hard wear resistant insert 16. The hard wear resistant means 26 is preferably a cemented hard metal carbide material, and located adjacent a rear surface 28 of insert 16 when mounted in place.

Figure 2:
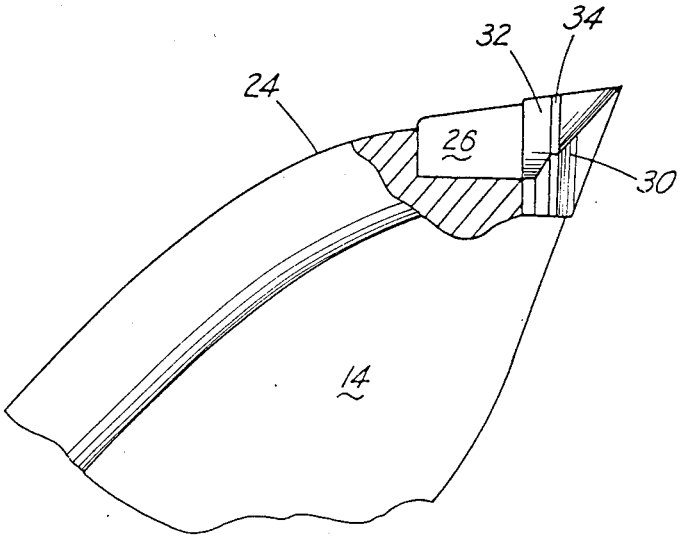
FIG. 2 is a side, cut-away view of a cutter bit according to the present invention.

Shown more clearly in FIG. 2 is a partially cut-away view of the forward working portion 14 having a hard wear resistant means 26 located in the clearance face 24. However, individual carbide inserts 30 and 32 form a composite or laminated insert with each being brazed to metal shim member 34. Preferably, the inserts 30 and 32 are formed of a cemented hard carbide material and are brazed to a steel shim member 34.

The hard wear resistant means 26 is preferably comprised of a hard wear resistant cemented metal carbide material.

The advantage of the composite or laminated insert is that some materials that are hard and wear resistant, such as a cemented hard metal carbide, are subject to failure due to heat checking. By making the lead insert a composite of at least two individual inserts connected to a shim, or connected to each other as by brazing, the temperature differential across each carbide insert is reduced which, in turn, reduces the tendency for heat checking and, further, if cracks in the individual carbide members do develop, then propagation is arrested by the metal shim or braze connection separating the two individual inserts 30 and 32.

Figure 3:
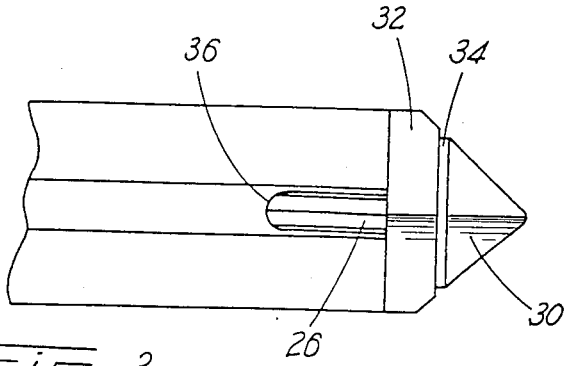
FIG. 3 is a top view of a cutter bit according to the present invention.

Shown in FIG. 3 is a top view of the cutter bit of FIG. 2, showing the insert 30, shim member 34 and the second insert 32. An elongate slot 36 is formed so that hard wear resistant means 26 can be placed in slot 36 and brazed in place. The hard wear resistant means 26 may firmly abut or be located adjacent a rearmost portion of insert 32.

Shown in FIG. 4 is another cutter bit 40 having a forward working portion 14 and the laminated or composite inserts 30 and 32 brazed to a copper shim 34. In this figure, the wear resistant means is comprised of a cylindrical hole 42 into which a cylindrical insert 44 is brazed into place. Insert 44 has a rounded outer surface and, again, is mounted in the clearance face 24 rearwardly of the laminated cutting inserts 30 and 32 and projects upwardly from clearance face 24.

FIG. 4A shows a top view of the cutter bit of FIG. 4, indicating the laminated insert comprised of inserts 30 and 32 is brazed to shim 34 and has the hard wear resistant means 44 located rearwardly of the inserts on the clearance face 24.

Figure 5:
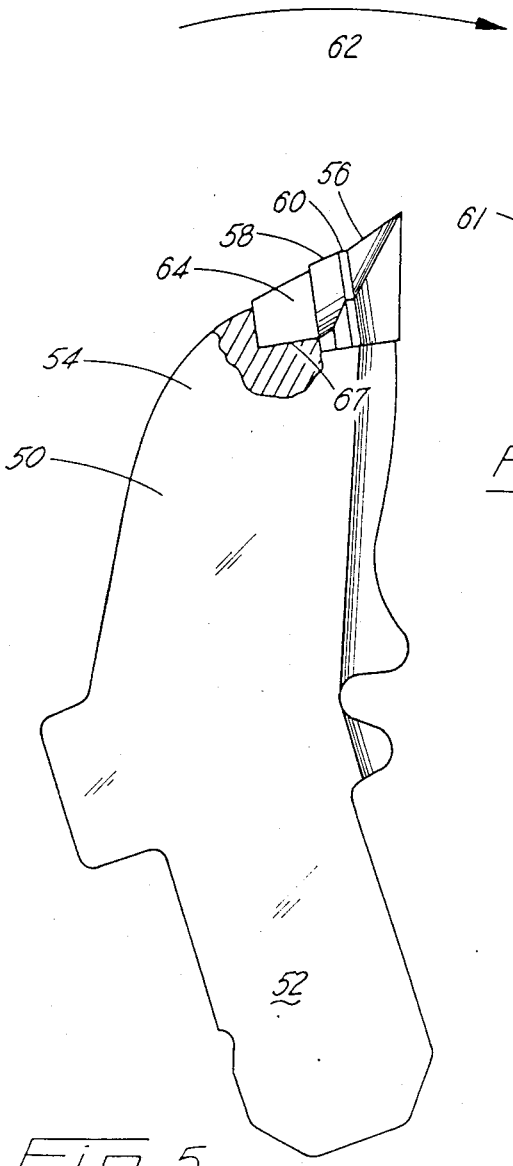
FIG. 5 is still another embodiment of the multi-insert cutter bit of the present invention.

Shown in FIG. 5 is another embodiment of a flat cutter bit according to the present invention. The cutter bit 50 has a rectangular shank 52 and a forward working portion 54 upon which are mounted inserts 56 and 58. The inserts 56 and 58 are brazed to a shim member 60 and form a laminated insert on the cutter bit 50. The direction of rotation is again shown by arrow 62. Immediately behind inserts 56 and 58 is a hard wear resistant means 64 which is located rearwardly of insert 58 in the direction of travel of cutter bit 50 and immediately adjacent insert 58.

Figure 5A:
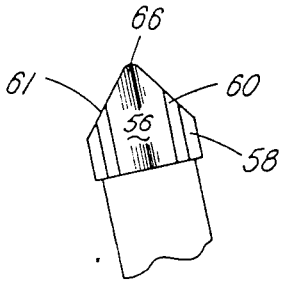
FIG. 5A is a partial front view of the cutter bit of FIG. 5.

Shown in FIG. 5A is a partial front view of the cutter bit of FIG. 5 showing parts of insert 56, shim member 60 and insert 58. A cutting edge 66 is formed on the inserts 56 and 58 and is so configured that it tapers outwardly toward the shank 52 of the cutter bit 50 and is usually U-shaped or V-shaped when viewed from the front. Of all of the previously described inserts, this is the preferred configuration of the cutting edge when viewed from the front, whether or not a single insert is located at the forward working portion of the cutter bit, or whether a laminated insert configuration is located in the forward working portion of the cutter bit.

Specifically, as shown in FIG. 5, the inserts 56 and 58 are formed so that the cutting edges on both inserts, when located in place on the cutter bit 50, form a V-shaped cutting edge which tapers outwardly toward a shank 52. The hard wear resistant means 64, when placed in the recessed slot 67 of the forward working portion 54, aids in maintaining the tapered cutting edge 66 throughout the life of the cutter bit. It is believed that maintaining of the tapered cutting edge provides a more efficient and proper cutter bit than previously known bits. Cutting edge 66, as shown in FIG. 5, is narrower than the cutting edge 61 on insert 58 so as to provide greater wear resistance at the center of the cutting bit.

Figure 6:
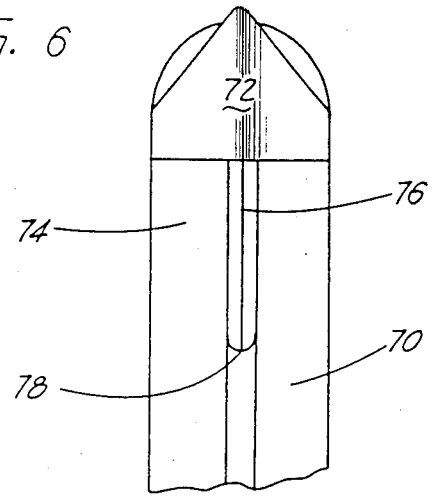
FIGS. 6 and 7 are top views of different embodiments of multi-insert cutter bits according to the present invention.
Figure 7:
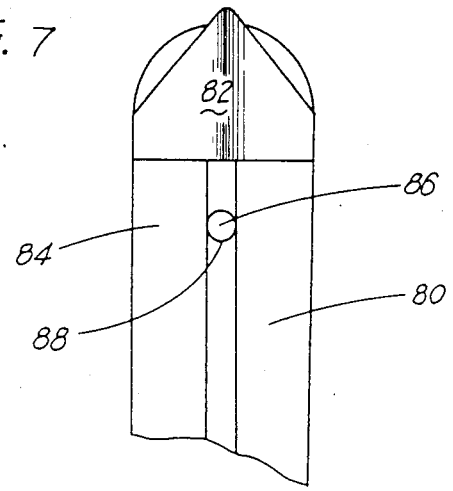

Shown in FIGS. 6 and 7 are top views of different embodiments of multiple insert cutter bits according to the present invention.

Shown in FIG. 6 is a top view of a cutter bit 70 having a single insert 72 mounted in the forward working portion 74 of the bit 70 and located immediately behind the insert 72 is an elongate wear resistant means 76 mounted in slot 78 formed to specifically have hard wear resistant means 76 held therein.

Shown in FIG. 7 is again a cutter bit 80 having a single insert 82 mounted on the forward working portion 84 of the bit 80. In this case, a cylindrical hard wear resistant means 86 is mounted in a cylindrical hole 88 rearwardly of insert 82 from the direction of travel of the bit 80.

Shown in FIG. 8 is a forward working portion 90 of a still further embodiment of a multiple insert cutter bit according to the present invention.

In FIGS. 8 and 9 is shown a lead insert 92 mounted in front of a second insert 94 with each of the inserts brazed to an individual shim member 96 mounted on the forward part of the clearance face 98 of the cutter bit 100. Immediately behind insert 94 are located two cylindrical inserts 102 and 104 which project from the clearance face and form the hard wear resistant means which will aid in maintaining a tapered cutting edge 106 on the cutter bit 100 as previously described.

Figures 10, 10A:
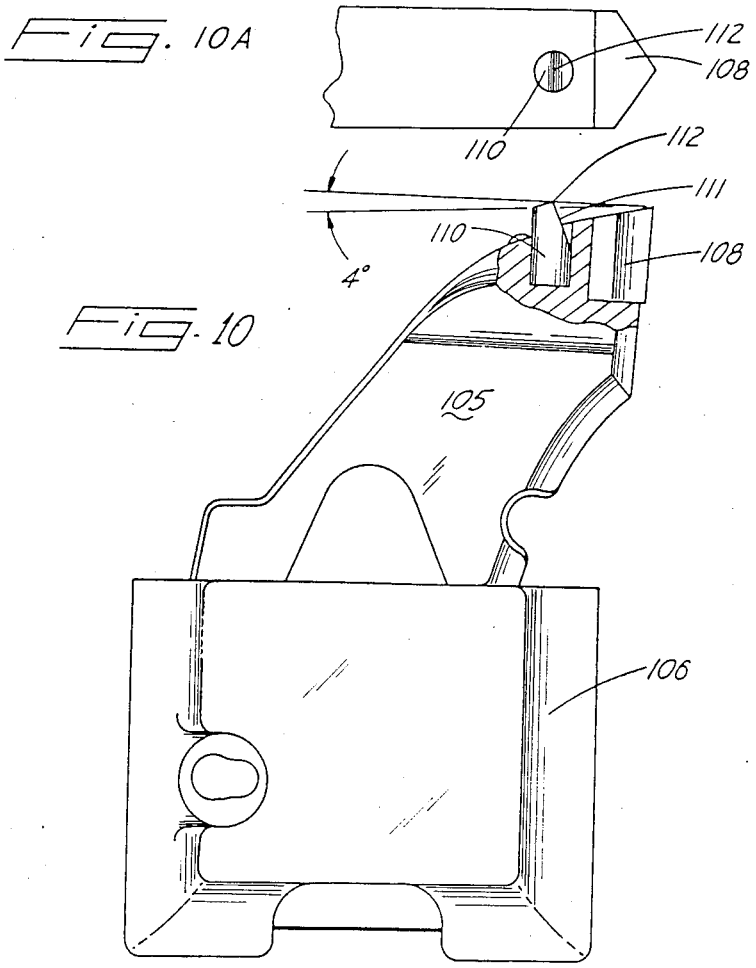
FIG. 10 shows a side view of a type of bit shown in FIG. 7.
FIG. 10A is a top view of FIG. 10.
Figure 11:
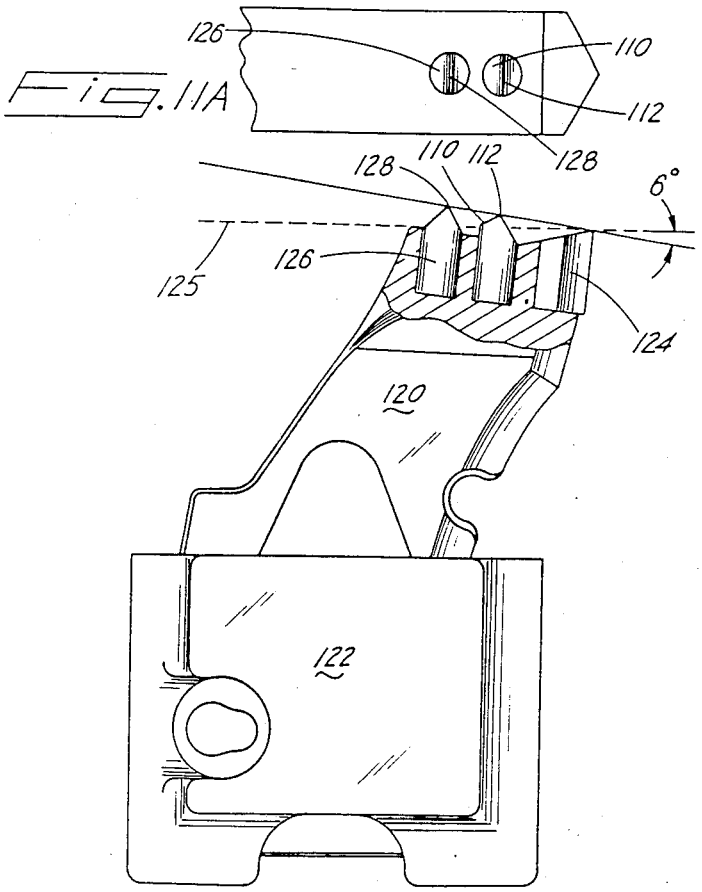
FIG. 11 is a modified bit of the type shown in FIG. 10.

Referring back to FIG. 7, more details of the construction are shown in FIG. 10 and modifications of such a bit are shown in FIG. 11.

The bit 105 in FIG. 10 is shown inserted into block 106 and has a foremost carbide compact 108 and a second carbide compact 110 located rearwardly of the forwardly facing compact 108. Compact 110 is cylindrical in nature but has a flat 111 placed on its forward side such that a cutting edge 112 is created on the compact. The cutting edge 112 is located on an approximately four to six degree line drawn along the back rake of the bit 105. The angle can be demonstrated by constructing a plane perpendicular to the longitudinal axis of the shank of the bit and passing it through the apex of the cutting edges of the lead insert.

Testing of these bits has revealed that the clearance face wears on an approximately four to six degree angle when compared to a horizontal line parallel to the base block 106 into which the bit 105 is inserted. It is, therefore, believed that the cutting edge of the trailing insert 110 should be placed on a line of approximately four to six degrees from the clearance face so that it may have a cutting action similar with the foremost compact 108 while also preventing wear along the clearance face. The positive angle shown, although preferably varying from four to six degrees, could vary more depending upon the feed of the cutting drum down the face of the coal to be cut. It has been found that, for most feeds, four to six degrees is preferable, but the faster the drum feeds down the coal face, the greater the angle will have to be in order to achieve optimum cutting.

A further modified bit 120 is shown in holder 122 in FIG. 11. This bit has a lead insert 124, a second cylindrical insert 110 as described in FIG. 10 and a third cylindrical insert 126, with each of the inserts 110 and 126 having a flat produced thereon such that a cutting edge 112 and 128 are provided on the inserts.

Again, as shown, the inserts 110 and 126 have their cutting edges 128 and 112 located on a line tilted approximately four to six degrees along the clearance face of the bit 120 because it is believed desirable to have all the inserts simultaneously perform a cutting action when in use.

FIGS. 10A and lIA show top views of FIGS. 10 and 11, respectively. In FIG. 10A, forward insert 108 is shown along with a cylindrical insert 110 having a cutting edge 112. Similarly, in FIG. 11A, a top view is shown having the insert 110 with a cutting edge 112 and an insert 126 even behind insert 110 having a further cutting edge 128. Again, it is desirable to place all the cutting edges near or on a line of six degrees from a horizontal line 125.

Figure 12:
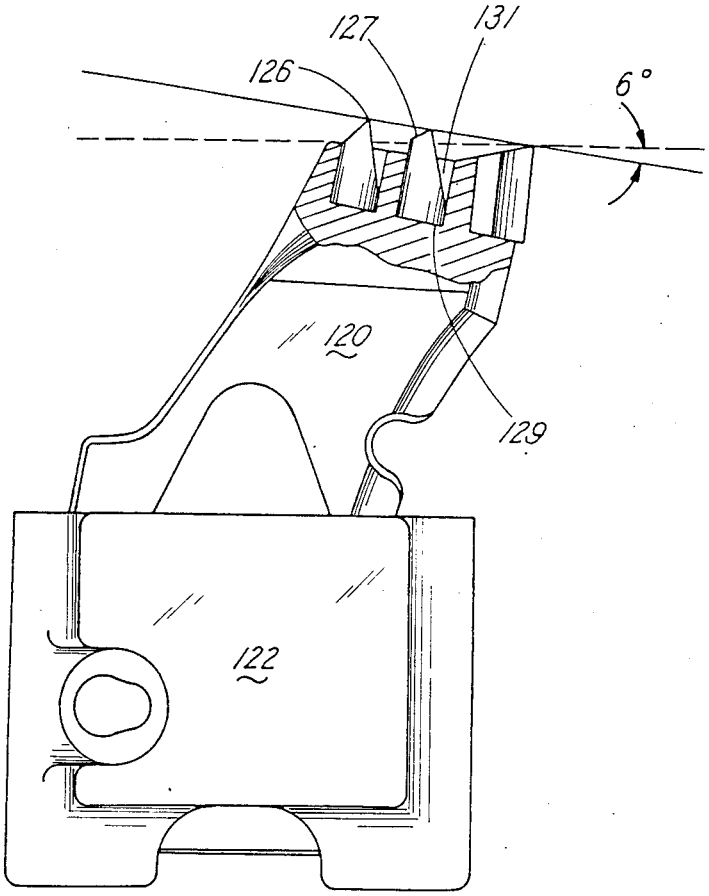
FIG. 12 is a side view of a further modification of a bit according to the present invention.

In FIG. 12, a further modification is shown with the third insert 126 shown in its position. However, insert 127 is now shown as a cylindrical plug, when viewed in side, tapering from top to bottom and inserted in hole 129 and brazed in place with braze 131. By placing insert 127 in the bit in this fashion, it is believed that, as the insert wears down, it, itself, has a self-sharpening effect in that the tapered section always presents a fresh cutting edge to the material to be cut.

Shown in FIG. 13 is the insert 131 shown in end view as a cylindrical plug and tapering from one end to the other.

FIG. 13A shows the insert 131 in side view, again having a taper from one end to the other.

Shown in FIG. 11, the included angle of six degrees can be constructed by forming a plane perpendicular to the longitudinal axis of the shank of the bit 120 and passing it through the uppermost tip of the foremost cutting insert 124. The six degree line shown in FIG. 11 then intersects that plane and has the cutting points 112 and 128 either in line or adjacent to the six degree angle.

Modifications may be made within the scope of the appended claims.

What is claimed is:

1. In a cutter bit, the combination comprising:

a shank portion for insertion into a toolholder, a forward working portion on said shank portion for engagement with the material to be cut, hard wear resistant means with a first cutting edge on said forward working portion, said cutting edge having sides tapering outwardly toward said shank portion when viewed from a front view, a clearance face behind said cutting edge, and a wear-controlling insert of hard wear resistant material mounted in said clearance face behind said hard wear resistant means, said wear-cotnrolling insert projecting above the surface of the clearance face so as to reduce the rate of wear and maintain the taper of said first cutting edge duing the life of the bit, said hard wear resistant means comprising at least two discrete wear resistant cutting inserts connected together so as to reduce the tendency of the hard wear resistant means to fail by heat checking, each of said inserts having a cutting edge that, when viewed from the front, tapers outwardly toward the shank of the bit.

2. The bit according to claim 1 in which said forward working portion has an elongated slot defined in said clearance face extending rearwardly from and located behind said hard wear resistant means, and said wear-controlling insert being of elongate configuration and mounted in said slot.

3. The bit according to claim 2 in which said hard wear resistant material is comprised of cemented hard metal carbide.

4. The bit according to claim 1 in which said cutting inserts are connected together by a shim member disposed between said two inserts and means for fastening said inserts to said shim member.

5. The bit according to claim 1 in which said forward working portion has a first cylindrical recess defined in said clearance face located behind said hard wear resistant means, and said wear-controlling insert of hard wear resistant material being of elongate cylindrical configuration and mounted in said recess.

6. The bit according to claim 5 which further comprises a second cylindrical recess formed in said clearance face behind said first cylindrical recess and a second elongate cylindrical insert mounted in said second recess.

7. The bit according to claim 1 which further comprises the cutting edge of the first discrete insert forming the hard wear resistant means is narrower than the cutting edge of the second discrete insert forming the hard wear resistant means when the two discrete inserts are viewed from a front view.

8. The bit according to claim 1 which further comprises a cutting edge formed on the end portion of said wear-controlling insert projecting from the surface of said clearance face.

9. The bit according to claim 8 which further comprises a part of the cutting edge of the wear controlling insert in the clearance face passing through or located adjacent a first plane forming an includd angle of tow to ten degrees of a second plane formed perpendicular to the longitudnal axis of the shank of the bit and passing through the tip of said hard wear resistant means on said forward working portion.

10. The bit according to claim 9 which further includes said first and second planes forming an included angle of approximately four to six degrees.

11. The bit according to claim 10 which further includes at least two wear-controlling inserts mounted in said clearance face, each of said two inserts having a cutting edge and the tips of said cutting edges each located in or adjacent to said first plane.

12. The improved bit according to claim 8 in which said wear-controlling insert in said clearance face comprises an elongate cylindrical plug member.

13. The bit according to claim 12 in which said plug member has a planar flat formed thereon and said flat intersects one end of said plug member to form a cutting edge.

14. The bit according to claim 13 which further comprises the plane of said flat tapering away from the center line of said plug member as it extends away from said cutting edge.

* * * * *